United States Patent [19]

Dombrowski

[11] 4,086,688

[45] May 2, 1978

[54] METHOD FOR IMPARTING COLORATION TO A KNIT/DEKNIT TEXTILE YARN

[76] Inventor: Edward J. Dombrowski, Rte. 7, Box 262 Pinewood Circle, Asheboro, N.C. 27203

[21] Appl. No.: 737,476

[22] Filed: Nov. 1, 1976

Related U.S. Application Data

[63] Continuation-in-part of Ser. No. 664,553, Mar. 8, 1976, abandoned.

[51] Int. Cl.[2] ..... D02G 1/00; D04B 19/00

[52] U.S. Cl. ..... 28/218; 8/149; 8/154; 68/205 R

[58] Field of Search ..... 28/72.16, 218; 68/201, 68/205 R; 8/154, 149

[56] References Cited

U.S. PATENT DOCUMENTS

| | | | |
|---|---|---|---|
| 3,547,575 | 12/1970 | Theodores | 68/201 X |
| 3,566,622 | 3/1971 | Iannucci | 28/72.16 UX |
| 3,599,450 | 8/1971 | Giesler et al. | 68/201 |
| 3,696,642 | 10/1972 | Rigacci | 68/205 R X |
| 3,724,997 | 4/1973 | Von Der Eltz et al. | 68/201 X |
| 3,828,405 | 8/1974 | Devinney et al. | 28/72.16 |
| 3,986,235 | 10/1976 | Norris | 8/154 X |

FOREIGN PATENT DOCUMENTS

| | | | |
|---|---|---|---|
| 1,240,338 | 7/1971 | United Kingdom | 28/72.16 |

OTHER PUBLICATIONS

*Producing Knit-De-Knit Yarns,* Man-Made Textiles, pp. 30, 31, 33, Jun., 1967.

*Primary Examiner*—Robert R. Mackey

[57] ABSTRACT

A roll of knit tubing, which has been knit into a tubular shaped prefabric in the first stage of a knit/deknit process, is presented successively to one or more dyeing stations while in a rolled or coiled package. Dyestuff is applied to the roll at selected positions on at least one side surface thereof in such amounts as to form regions of dye which spread in all directions through a plurality of convolute layers. The dye and stitch are then simultaneously heat set in an autoclave and the tube deknitted according to conventional practices to provide a textured yarn having random color variations therein.

7 Claims, 5 Drawing Figures

METHOD FOR IMPARTING COLORATION TO A KNIT/DEKNIT TEXTILE YARN

REFERENCE TO RELATED APPLICATION

The present application is a continuation-in-part of applicant's co-pending application Ser. No. 664,553, filed Mar. 8, 1976, now abandoned.

BACKGROUND OF THE INVENTION

One of the known methods for texturing or texturizing a synthetic yarn is known as the "knit/deknit" process in which a yarn end is tightly knit into a tubular prefabric, the stitch is heat set, and the prefabric is then unraveled (deknit) and taken up onto a yarn carrier. Treated in this manner the resulting yarn has a characteristic texture and bulk, or "crinkle". One of the side advantages of the knit/deknit process is that while the yarn is in the tubular prefabric form it can be space dyed, so that upon deknitting, there is formed a yarn of multicolors.

The most common practice in space dyeing the tubular prefabric is to pass the tube lengthwise through a printing operation wherein the colors are printed thereon as described in U.S. Pat. No. 3,012,303, issued Dec. 12, 1961. A somewhat different approach is taken in U.S. Pat. No. 3,828,405 issued Aug. 13, 1974 in which the tubular prefabric is again advanced lengthwise along a predetermined path while dyestuff is freely dribbled thereon from a nozzle overlying the path of travel, whereupon the tube is passed through rolls which press the tube flat and force migration of the dyestuff differentially throughout the material.

In each of the aforementioned methods, it is necessary to advance the tubular fabric lengthwise past a dye station or through printing rolls. The knit tube, upon completion of the knitting operation, is conventionally rolled upon itself or a carrier into a coil-type package comprising a plurality of convolute layers of knit tubing. During the dyeing operations according to the above-mentioned processes, the knit tubing must be completely unrolled and processed linearly or lengthwise past the dyeing station.

A roll or package of tubing contains about 500–700 linear feet of knit tubing. When the knit tubes must be unrolled and passed lengthwise by the dye station, the dyeing operation takes at least 20–30 minutes per package, depending upon the length, consistency of the dyestuff, and the like. Further, according to general practices, the knit tubing is subjected to an autoclave to set the stitch after the knitting operation, then the dyed tube is passed through a dry oven prior to rolling or coiling to set the color therein. Obviously such dyed rolls cannot be autoclaved prior to or simultaneously with heat setting, since the colors would run onto the adjacent layers.

The time consuming processes described hereinabove have caused prices for yarn dyed in this manner to remain so high that the use of such yarn has been severely restricted.

SUMMARY OF THE PRESENT INVENTION

The present invention is directed to an improved dyeing process for achieving a random color pattern, whereby the dyeing operation can be accelerated to such an extent that the cost per pound of dyeing is reduced to make such yarn desirable for many additional uses not possible before. In accordance with the present invention, after the yarn is initially knit into the tube, the tube is rolled upon itself or on a core into a coil-like package and presented to one or more dyeing stations while rolled and without unwinding. Prior to autoclaving, dye or dyestuff is then applied to selected positions on or through the side surfaces of the rolled package. The dye may be all of the same color, or it may be of different colors. Further it may be applied in such amounts that will spread and completely cover one side surface to a prescribed depth or in such amounts that the dyes will form separate or discrete regions of color on the side surfaces. The package may then be reversed at the same station, or it may proceed to another dye station where dyes of a different color are applied to other spaced positions in the same manner. Upon completion of the dyeing steps or processing through the dyeing stations, the coil-like packages are introduced into an autoclave where both the dye and the stitch are simultaneously set under steam heat.

As a result of the improved dyeing process according to the present invention, dyeing cost per pound can be cut by one-half or more compared to other known processes. It can be easily seen that space dyeing of the entire package, rather than subjecting the tubular prefabric longitudinally through dyeing stations is considerably quicker and less expensive. Further, added economies are achieved through the simultaneous setting of the color and stitch in the autoclave.

It is therefore an object of the present invention to provide an improved method for the space dyeing of a knit/deknit yarn to provide a final yarn product having random color variations along the length thereof.

It is another object of the present invention to provide a more economical process for space dyeing knit/-deknit yarn in which complete packages of rolled up knit tubing are subjected to one or more successive dyeing stations where dyestuffs are applied to the circular side surfaces of the coiled packages in such amounts as to either form a solid side color or separate regions of pigment, then subjected to autoclaving to simultaneously set the color and stitch.

Other objects and a fuller understanding of the invention will become apparent as the description proceeds, when taken in connection with the accompanying drawings, in which.

The method according to the present invention is directed to a more economic approach to the imparting of randon color variations to knit/deknit yarn. The tubular fabric initially formed is conventionally rolled up or coiled into a package having a plurality of convolute layers of knit tubing spirally wound upon each other as illustrated at P in FIG. 2.

According to the present invention, this coil type package P is presented to one or more dye stations as a package without unrolling, and dye is applied to selected points or on through the circular side surface of the package. The pigment seeps or migrates across and throughout several convolute layers of the package to form initially separate regions of dyestuff therein. The selected points may be spaced, so that different colors may be applied to the side surfaces and form separate regions of dyed material. Also the same color may be applied throughout the side surface and in such amounts as will completely cover the side surface with a single color. The opposite side may be covered with the same or different color in like manner so that the sides or edges of the coiled package are dyed while the central section will not. This will also result in a spaced dyed, but less random color pattern in the resulting fabric.

Figure 1:
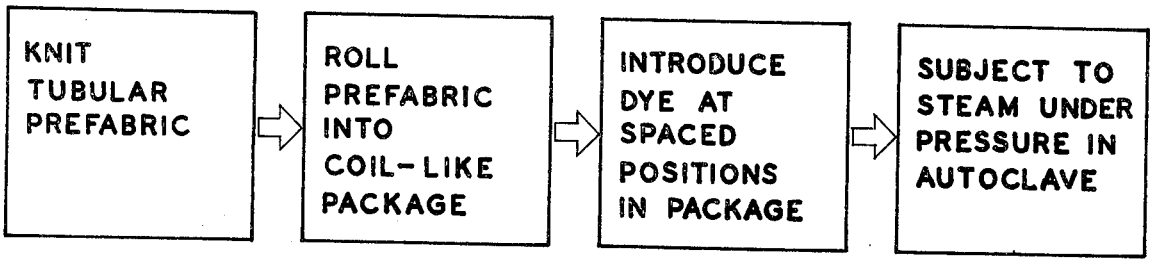
FIG. 1 is a block diagram schematically illustrating the steps carried out in the present method of space dyeing knit/deknit yarn.
Figure 2:
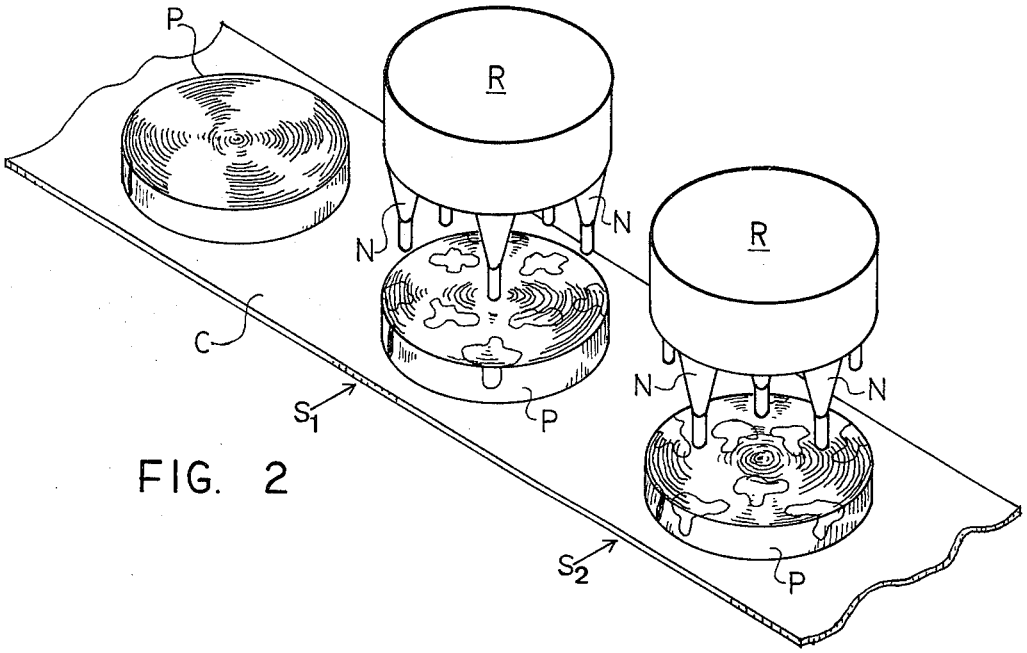
FIG. 2 is a schematic illustration of a conveyorized arrangement for processing the packages of knit tubing past one or more dyeing stations.

The dye can be applied to the packages P in accordance with any one of the above procedures or according to other procedures. One method or technique for the application of color in the method according to this invention is taught in applicant's co-pending U.S. application Ser. No. 732,091, filed Oct. 13, 1976, now U.S. Pat. No. 4,047,405 granted Sept. 13, 1977. Further as illustrated in FIG. 2, in another embodiment, the packages P are laid on one side thereof on a conveyor C, whereupon the package progresses to a first dye station S1.

At the first dye station S1, there is suitably mounted above the conveyor a hopper or reservoir R which contains a first pigment or dye color. A plurality of nozzles N depend from reservoir R, and upon stoppage of the package P thereunder, the nozzles N are all lowered or the packages P raised, according to conventional practices, so that nozzles N approach or even slightly penetrate between adjacent layers of the exposed circular side surface of the package. That is to say, the lower end of the nozzles N will be pushed down into the package P between adjacent layers of knit tubing, whereupon a prescribed amount of dye will be released at positions determined by the spacing and positioning of the nozzles N. The size of the nozzle openings, as well as the length of time the nozzles are opened and the amount of penetration by the nozzles, can vary to provide regions of different size, as desired or according to a random pattern. Where the nozzles N introduce dye into the intermediate portions of the package, as well as on the surface, the regions of dye may well spread throughout the package, so that it is not even necessary to introduce dye on the lower surface on which packages P rest in FIG. 2.

Where the multiple colors are to be applied at successive dye stations, after completion of the application of the first color, conveyor C is indexed to bring the dye package into a position beneath the second dye station S2 where a second color is applied in a similar manner to the first. Of course, it should be realized that the nozzles of the second dye station introduce dye into the package P therebeneath at different points than the nozzles of the first station, so that the second color is applied in regions distinct and separate from the first. The rolled up packages of tubular prefabric may be subjected to several such dye stations S to apply several different colors. It is obvious that the size of the outlets of nozzles N, or the amount of time the nozzles are allowed to remain open will determine the size of each region of dyestuff formed thereunder. The nozzles at each dye station may, if desired, be separately activated and deactivated, and may be of varying size so that the regions of each color vary in size.

Figure 3:
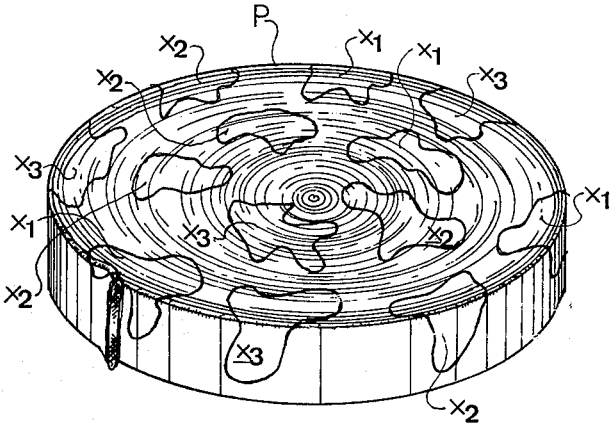
FIG. 3 is a perspective view illustrating a package as it appears after it has been dyed.

Upon completion of the dyeing step in an embodiment with multiple colors on each side surface, the resulting package appears as illustrated in FIG. 3, in which a plurality of dyed regions X1, X2, and X3 occur at spaced points throughout the knit tube package. Later, upon unraveling, a completely unique type of yarn coloration is realized with a random application of colors thereto formed in a much more economical way than has been heretofore known. Surprisingly, the same is the case even where a single color is applied with the central portion between the sides left free of dye.

Figure 4:
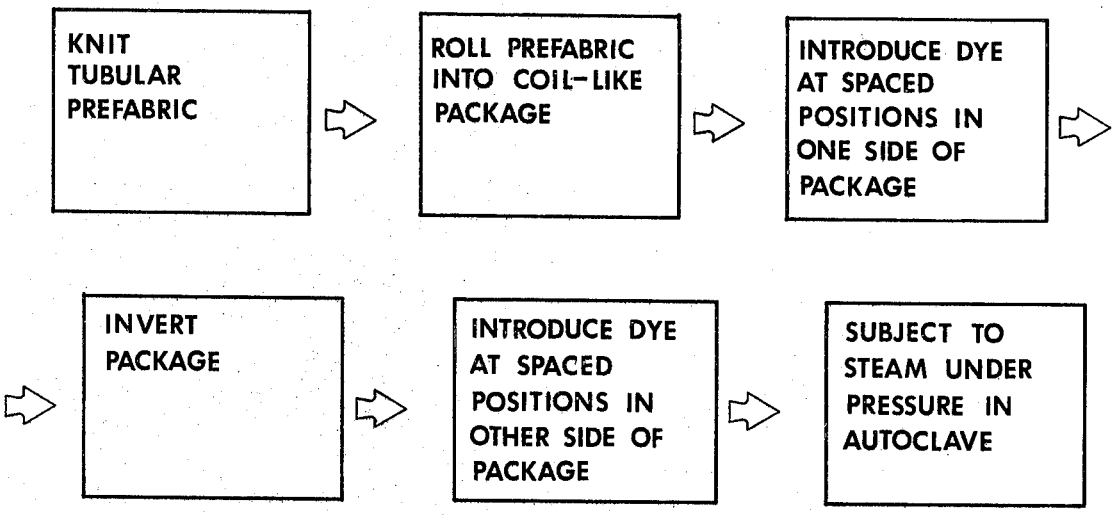
FIG. 4 is a block diagram schematically illustrating an alternate embodiment of the method.
Figure 5:
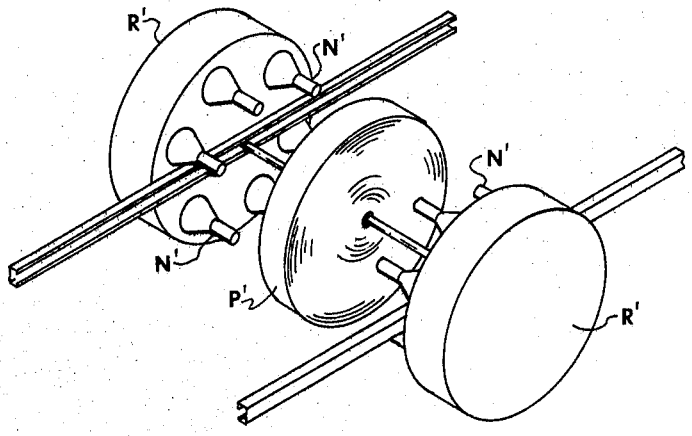
FIG. 5 is a schematic illustration of a conveyorized arrangement whereby rolls are presented to opposed dyeing heads to dye both sides simultaneously.

Once it is realized that the heart of the invention lies in introducing dyestuffs onto or into the side circular surface of the tubular prefabric while in the rolled up package form, it is apparent that the actual application of the dyestuff can be accomplished according to one of several known techniques. For example, rather than having the nozzles N being forced into and between convolute layers of the dye package (FIG. 2) or in a dye fixture as illustrated and described in applicant's co-pending application Ser. No. 732,091, filed Oct. 13, 1976, selected amounts of dye could be dripped by gravity onto the exposed surface of package P at a first set of dye stations. The package could then be inverted 180° and passed through a second series of dye stations where dyestuff is dripped by gravity onto the other side surface thereof, which would form a satisfactory product. See FIG. 4. In yet another method, the rolled up knit tube packages P′ could be presented to a dyeing station R′ and so supported that the side surfaces of the package are vertically oriented. See FIG. 5. Nozzles could be presented to the surfaces from the side thereof to simultaneously inject the dyestuff onto the side surfaces or into the space between the convolute layers thereof. Also, it might be possible to apply more than one color at one station, if, for example, some of the nozzles N in FIG. 2 were connected to reservoirs containing different colors. Obviously where a single color is applied, multiple stations should not be necessary, except if a different color is applied to the opposite side.

It has been found that the satisfactory application of three colors to a 3 pound roll of knit fabric, which is approximately 500 to 600 feet of knit tubing, can be accomplished in approximately 15 seconds. This is compared with conventional processes of printing or applying dyestuff to the knit tubing as it is unrolled and proceeds longitudinally past the dyeing stations, which process may take up to 20 to 30 minutes. Further this savings does not take into consideration the elimination of the duplication of the heat setting effort.

Subsequently to the dyeing operation, the rolls or packages are put on racks and into an autoclave which is preferably maintained at 270° F. at 27 PSI, however this temperature and pressure can vary depending on colors and yarn. In the autoclave, the dye is set. Simultaneously the knit stitch in the prefabric may be set also, which obviates the necessity for a separate heat setting step between the knitting and dyeing operation as is normally required.

It should be apparent that various changes and modifications might be made to the specific dyeing process set forth hereinabove without departing from the scope of the invention which is to be limited solely by the following claims.

I claim:

1. An improved method of imparting space dyed color variations to a knit/deknit textile yarn of the type which is knit into a tubular prefabric, the tube rolled into a coil-like package having substantially circular side surfaces, heat set, and subsequently deknit to impart a desired textured characteristic to the yarn, comprising the steps of:

a. positioning said coil-like package of tubular prefabric to at least one dyeing station while rolled into said package;

b. applying dye at said dyeing station to selected areas on at least one of the circular side surfaces of said package in such amounts as to seep of its own volition throughout a plurality of adjacent convolute layers;

c. discontinuously with the dyeing, subjecting said package to an autoclave while still in the rolled up configuration to simultaneously set the dye and the knit stitch.

2. The method according to claim 1 wherein at least part of the dye is introduced into intermediate portions of said package between adjacent convolute layers thereof.

3. The method according to claim 1 wherein the step of applying dye includes the introduction of dye from a point external of said package onto one side surface of the package, inversion of the package and the introduction of dye in the same manner to the opposite side surface.

4. The method according to claim 1 wherein step (b) includes the introduction of dye onto both circular side surfaces simultaneously while holding the package with the side surfaces in a substantially vertical plane.

5. A method of space dyeing a textured yarn comprising the steps of:

a. knitting synthetic, heat settable yarn on a circular knitting machine to form a tubular prefabric;

b. rolling up the knit tube into a coil-like package having substantially circular side surfaces;

c. discontinuously with the knitting introducing dye to the edges of said tubular fabric at a plurality of selected points on at least one circular side surface of said coil-like package in such amounts that the dye will seep of its own volition throughout a plurality of adjacent convolute layers;

d. applying steam heat to said package to simultaneously set the dye and the stitch; and e. prior to further treatment other than dyeing unraveling the knit tube to form a textured yarn having completely random color variations along the length thereof.

6. The method according to claim 5 wherein step (c) includes the application of a plurality of different dye colors to spaced points on each side of said package.

7. The method according to claim 6 wherein in step (c) a first color is applied to one circular side surface of said package and a second color is applied to the other circular side surface of said package.

* * * * *